US011554596B2

(12) United States Patent
Schreiter et al.

(10) Patent No.: US 11,554,596 B2
(45) Date of Patent: Jan. 17, 2023

(54) HEATABLE DOCUMENT CARRIER DEVICE AND DOCUMENT PROCESSING SYSTEM

(71) Applicant: Mühlbauer GmbH & Co. KG, Roding (DE)

(72) Inventors: Julia Schreiter, Neukirchen (DE); Stefan Muller, Zwonitz (DE)

(73) Assignee: Mühlbauer GmbH & Co. KG, Roding (DE)

( * ) Notice: Subject to any disclaimer, the term of this patent is extended or adjusted under 35 U.S.C. 154(b) by 0 days.

(21) Appl. No.: 17/527,871

(22) Filed: Nov. 16, 2021

(65) Prior Publication Data

US 2022/0153012 A1 May 19, 2022

(51) Int. Cl.
*B41J 11/00* (2006.01)

(52) U.S. Cl.
CPC ..... *B41J 11/0024* (2021.01)

(58) Field of Classification Search
CPC ..... B41J 11/0024; B41J 13/12; B41J 11/06; B65H 2701/1914; B65H 5/04
See application file for complete search history.

(56) References Cited

U.S. PATENT DOCUMENTS

| | | | | |
|---|---|---|---|---|
| 9,352,588 | B1 | 5/2016 | Boland et al. | |
| 2002/0031389 | A1* | 3/2002 | Wotton | B41J 11/06 400/648 |
| 2004/0141041 | A1 | 7/2004 | Tsutsumi et al. | |

FOREIGN PATENT DOCUMENTS

| | | | |
|---|---|---|---|
| DE | 19780153 | T1 | 2/1998 |
| DE | 102006031024 | A1 | 1/2008 |
| DE | 202008007564 | U1 | 8/2008 |
| DE | 102018119178 | A1 | 2/2020 |

* cited by examiner

*Primary Examiner* — Bradley W Thies
(74) *Attorney, Agent, or Firm* — Wood Herron & Evans LLP

(57) ABSTRACT

A document carrier device is provided for supporting and transporting a document in a document processing system. The device includes a workpiece carrier having a support surface for receiving a document; a heating device having a heat conducting element for transferring heat generated; and an actuator for causing relative movement between the heat conducting element and the workpiece carrier to change between a first mode of operation and a second mode of operation. In the first mode of operation, the heat conducting element extends, without thereby being in mechanical contact with the workpiece carrier, through one or more recesses in the workpiece carrier in the region of the support surface to be able to transfer heat generated by the heating device, at least in part, to a document received. In the second mode of operation, the heat conducting element has a distance from the support surface which is increased.

21 Claims, 5 Drawing Sheets

HEATABLE DOCUMENT CARRIER DEVICE AND DOCUMENT PROCESSING SYSTEM

CROSS-REFERENCE TO RELATED APPLICATION

This claims priority to German Patent Application No. 10 2020 130 239.8, filed Nov. 16, 2020. The above-mentioned patent application is incorporated herein by reference in its entirety.

TECHNICAL FIELD

The present invention relates to a document carrier device with a heating device, as well as to a document processing system, in particular a document personalization system. In this context, the documents to be processed may be documents in the form of a card or in the form of a booklet and may be security documents, such as for example identification documents or credit cards, bank cards, membership cards and the like.

BACKGROUND

A large number of different types of personalized documents, in particular in the form of a card or in the form of a booklet, are known from the prior art. Thus, for example, booklet-like passport documents or individual pages thereof (for example the "passport holder page", as it is referred to, or paper pages), identity cards and many types of personalized chip cards, such as bank cards, credit cards, identity cards, membership cards, access authorization cards, etc., or personalized labels (usually in the form of a card) all belong to the group of personalized documents.

In this context, "personalization" or "personalized" means that the respective document contains or carries document-specific information that is typically associated with a holder of the document. Thus, for example, in some cases, the information may identify the holder, for example by the holder's name, the holder's passport photograph, an identity number or other features which are printed on the document, are applied to, or introduced into, the document in some other way, or are stored in the document, in particular in the form of data. In this context, the personalization may in particular be individually related to a single person, or it may however also be related to a certain limited group of persons, for example employees of a company.

Instead of, or in addition to, a personalization of documents, it can be envisaged, in dependence upon the application, that a plurality of documents is processed in the same way, for example in order to provide each document with information that is the same for a plurality of documents and which is therefore not specific to each individual document.

In this context, the processing of the documents to apply to them information that is specific to each individual document and/or which is not specific to each individual document can be carried out in particular by printing, by engraving or, in particular in the case of a plastics material surface, by targeted local change of color of the surface material of the document, in particular in shades of gray or gradations thereof, by the application of energy, in particular by a suitable laser.

For some types of processing, it may in particular be necessary to at least temporarily heat the document to be processed, for example in order to dry, at an accelerated rate, the ink that has been printed on it, or in order to at least fix the ink that has been printed on it.

In the published application German Patent Application No. DE 10 2006 031 024 A1, a printing device and a method of applying printing to personalization documents are described. Here, the printing device comprises a printing unit for applying printing to a personalization document which is located in a printing area, and a feeding unit for successively feeding the personalization documents into the printing area. In this context, the feeding unit comprises a plurality of movable carrier devices for receiving a personalization document to which printing is to be applied and for moving it into the printing area and out of the printing area. The device further comprises a drive device for moving the carrier devices along a feed direction on different planes arranged perpendicularly to the feed direction. It further comprises a control unit for controlling the drive device so that the plurality of carrier devices are each moved alternately between a pick-up position, in which a personalization document is picked up, and the printing area. This is carried out in such a way that the drive device guides the plurality of carrier devices past each other on the different planes while moving in the feeding direction.

The printing device of German Patent Application No. DE 10 2006 031 024 A1 is intended in particular for the highly automated processing of a large number of documents with a high throughput, whereby in particular the loading and unloading, from the carrier devices, of the documents to be processed also takes place in an automated manner.

However, there are also applications in which a manual loading and unloading is envisaged instead, in particular in connection with the processing of small batches of documents or isolated document processing operations.

Thus, it would be desirable to provide a device in which an improved handling of documents is made possible in document processing systems which provide for heat treatment of the documents as they are being processed and for loading or unloading of the document processing system by an operator.

SUMMARY

To achieve this and other objectives, a document carrier device is provided in some embodiments of the invention for supporting and transporting a document in a document processing system, in particular in a document personalization system. The document carrier device comprises: (i) a workpiece carrier comprising a support surface for receiving a document; (ii) a heating device comprising a heat conducting element for transferring heat generated by the heating device; and (iii) an actuator for causing relative movement between the heat conducting element and the workpiece carrier in order to change between a first mode of operation and a second mode of operation of the document carrier device. In the first mode of operation, the heat conducting element extends, without thereby being in mechanical contact with the workpiece carrier, through one or more recesses in the workpiece carrier in the region of the support surface in order to be able to transfer heat generated by the heating device, at least in part, to a document received on the support surface of the workpiece carrier. In the second mode of operation, the heat conducting element has a distance from the support surface which is increased when compared with its position in the first mode of operation.

In the first mode of operation, the distance of the heat conducting element from the support surface may in particular be zero and it is even conceivable that the heat conducting element extends through the support surface in the region of at least one of the recesses and thus protrudes with respect to the support surface.

In the sense of the invention, a "document carrier device" is intended to be understood to mean a receiving device for a document to be processed, which receiving device is provided in order to transfer the document into an operating region of at least one processing device during the processing operation and in order to support the document during the course of this. For this purpose, the document carrier device can in particular be configured (i) to support the document in a tray-like manner, (ii) to receive the document at least partially in a cavity of the document carrier device, or (iii) to fix the document to, or in, the document carrier device by a fixing device, in each case in order to move the document along with the document carrier device as the latter is being moved.

In the sense of the invention, a "support surface" is intended to be understood to mean in particular an area on the surface of the document carrier device which is configured to come, and intended to come, into mechanical contact with a document to be processed when this document is received, in order to support the document during the period between it being loaded and unloaded, and/or to guide it during a movement which takes place during this process. In particular, the support surface, or at least portions thereof, may be flat.

In the sense of the invention, a "heat conducting element" is intended to be understood to mean a body which is made of a material which has a good thermal conductivity, wherein, in this context, this is intended to be understood to mean a thermal conductivity of at least 1 W/(K·m), preferably of more than 10 W/(K·m), and particularly preferably of more than 100 W/(K·m). In particular, the heat conducting element may be made of a metallic material, and may in particular contain or consist of iron or aluminum.

In the sense of the invention, a document is "received" on the support surface of the workpiece carrier when it is in mechanical contact with the support surface, in particular in such a way that a supporting force or carrying force is exerted on the document by the support surface. The support surface may therefore extend in particular in a horizontal direction. However, other positions and even positions which vary over time are also conceivable, so that the support surface does not necessarily have to act against the gravitational force acting on the document, but may be able to do so.

The terms "encompasses", "contains", "includes", "comprises", "has", "with", as may be used herein, or any other variation of these, are intended to cover an inclusion which is not exclusive. Accordingly, for example, a method or a device which encompasses or comprises a list of elements is not necessarily limited to those elements, but may include other elements which are not explicitly listed or which inherently form part of such a method or device.

Further, unless expressly stated to the contrary, "or" refers to an inclusive "or" and not to an exclusive "or". For example, a condition A or B is satisfied by any one of the following: A is true (or present) and B is false (or not present), A is false (or not present) and B is true (or present), and both A and B are true (or present).

The terms "a" or "an", as they are used herein, are defined in the sense of "one or more". The terms "another" and "a further" as well as any other variant thereof are to be understood in the sense of "at least one further".

The term "a plurality of", as it is used herein, is to be understood in the sense of "two or more".

In the sense of the invention, the terms "configured to" or "configuration", "set up to" or variations of these terms are intended to be understood to mean that the respective device is already prepared or can be adjusted—i.e. can be configured—to perform a particular function. In this context, the configuring or setting up can, for example, be carried out via a corresponding setting of parameters of a process sequence or of switches or the like implemented in hardware or software for activating or deactivating functionalities and/or settings.

In the document carrier device mentioned above, in the first mode of operation, i.e. while the document is being processed, the heat conducting element heated by the heating device can transfer heat to a document which is received on the support surface, for example in order to dry ink previously applied thereto, in particular printed ink, and thus fix it or even to dry it completely. On the other hand, during the preceding loading operation and the unloading operation following the processing operation, the nearest surfaces of the heat conducting element are arranged at a distance from the document and the support surface, within the at least one recess or even completely behind the workpiece carrier, as seen from the document surface, so that, for a user of a document processing system which is equipped with such a document carrier device, the risk of coming into contact with the heated heat conducting element during the course of the loading process or the unloading process and possibly acquiring a burn in the course of this is at least significantly reduced or even completely eliminated.

In particular, this also makes it possible for the heating device to be operated continuously instead of it being activated only during the actual document processing and it being deactivated for the purpose of it being manually loaded or unloaded. In particular, this also means that no cooling times are required with respect to the heat conducting element in order to ensure sufficient safety of the operator. The document carrier device thus has an integrated heating device and an integrated protection from burns, and is thus particularly user-friendly. Also due to the elimination of cooling and reheating times, the total time to be spent per document for loading, processing and unloading can be reduced in this way and thus a higher document throughput overall can be achieved.

In the following, preferred embodiments of the document carrier device will be described, each of which, as far as this is not expressly excluded or technically impossible, can be combined in any desired manner with one another and with the second embodiment of the invention described below.

In accordance with some embodiments, the heat conducting element comprises a plate-shaped body having a number $N \geq 1$ of protrusions which extend away therefrom from one side of the body. In this context, in the first mode of operation, each of the protrusions extend through an associated one of the recesses in the workpiece carrier without thereby being in mechanical contact with the workpiece carrier in order to be able to transfer heat generated by the heating device, at least in part, to a document received on the support surface of the workpiece carrier. By way of contrast, in the second mode of operation, the protrusions are at least partially retracted from their respective recesses so as to be at a greater distance from the support surface when compared with their respective position in the first mode of operation. This construction allows heat to be transferred to the document at various discrete locations of the document, while at the same time still allowing the heat conducting element to be formed in one piece and to provide the protection from burns mentioned above. In addition the transfer of heat at various discrete locations instead of a transfer of heat which is uniformly distributed over an entire surface portion of a document to be heated makes it easier to avoid undesirable local overheating, since excess heat can escape in the spaces between the protrusions, or at least less heating can take place.

In accordance with some embodiments, at least one of the protrusions has a cylindrical shape. In particular, this may equally apply to all other protrusions of the heat conducting element as well. This geometry promotes the most isotropic heat input possible at the locations of heat transfer, which also contributes to protection against local overheating or mechanical effects that could contribute to damage of the document, such as could more easily be the case with protrusions having an angular cross-section, for example.

In accordance with some embodiments, the workpiece carrier is resiliently supported by a suspension in such a way that, when the support surface is subjected to a contact pressure force which is directed at least partially orthogonally to the support surface, the workpiece carrier can move along a suspension travel path while at the same time giving rise to a counterforce caused by the suspension, which counterforce counteracts this movement. In this way, a fixing of the document can be effected by the contact pressure force and, in addition, due to the suspension, an adverse mechanical effect on the document by the contact pressure force can also effectively be avoided. Here, the workpiece carrier can in particular be constructed in the form of a pressure plate, that is to say a plate which, by the spring force of the suspension, can exert a pressure force on the document, which pressure force acts in the opposite direction to the contact pressure force (the counterforce mentioned above), so that a clamping effect which fixes the document (or an adapter which will be described below) is exerted on the document (or the adapter).

In this context, in some of these embodiments, the suspension travel path is limited in such a way that the workpiece carrier, when it is moved along the entire suspension travel path, does not come into mechanical contact with the heating device or with the heat conducting element directly or indirectly via at least one other component at any point of this movement. In this way, undesirable heating of the workpiece carrier as well as associated burn hazards for a user of the device or undesirable effects of temperature changes of the document, in particular in areas of the document which are not intended to be heated in the course of the processing of the document, can be avoided.

In accordance with some embodiments, the limitation of the suspension travel path can be formed in particular by a mechanical stop member for the movement of the workpiece carrier along the suspension travel path. This represents a particularly simple and reliable way of implementing a limitation of the suspension travel path.

In accordance with some embodiments, the suspension may comprise at least one spring element which comprises, or consists of, elastic foam material. In particular, at least one spring element may be formed as a foam mat or comprise such a foam mat. This represents a particularly low cost, reliable and robust, as well as durable way of forming the suspension.

In accordance with some embodiments, the document carrier device further comprises a cover which is arranged so as to be movable between an open position and a closed position. In the open position, it exposes the support surface for loading and unloading a document, and in the closed position, it acts as a clamping mechanism for fixing a document received on the support surface. In particular, the cover may also be constructed in such a way that, in the closed position, it can exert the pressing force, mentioned above, on a document received on the support surface. In order to enable a document received on the support surface to be processed, the cover may have one or more openings through which the processing of the document can be carried out, for example in the form of applying printing, a laser treatment or a transfer of data to a chip with a data receiving device and a data memory present in the document.

In accordance with some embodiments, the actuator is configured to effect the relative movement between the heat conducting element and the workpiece carrier on the basis of a principle of magnetic action. In this way, a particularly fast and energy-saving changeover between the first and the second mode of operation of the document carrier device is possible. Also, such a magnetic actuator can be implemented in a particularly space saving manner.

In accordance with some embodiments, the document carrier device further comprises a sensor device which is configured to detect, in a sensor based manner, a temperature of the workpiece carrier or of a document supported thereon, or another technical variable that is in a dependent relationship with this temperature. In this context, the document carrier device is configured to control the heating device as a function of the temperature or other technical variable detected by the sensor device. This can be used, in particular, in the sense of an open-loop control or closed-loop control of the temperature with respect to a target temperature or the avoidance of overheating or of temperatures that are not sufficiently high for the desired processing of the document. In this context, it is particularly advantageous that the sensor device, which may comprise one or more individual sensors, is itself part of the document carrier device and can thus be moved together with the latter and, in particular, with a document which may, if applicable, be accommodated therein, and which sensor device may in particular be moved within a document processing system equipped with such a document carrier device. Thus, irrespective of such a movement, continuous monitoring of the temperature and/or of the variable or variables which is/are in a dependent relationship therewith is made possible, in particular also in the case of a fixed relative spatial position between the sensor device and the document and/or the workpiece carrier as a whole, which promotes a particularly reliable measurement.

The sensor device may in particular be configured to measure a surface temperature of the workpiece carrier or of a document supported thereon, for example by a detection of infrared radiation. In the sense of the invention, the term "controlling" may cover both open-loop controlling (without a control loop) and/or closed-loop controlling (with a control loop) in the sense of open-loop and closed-loop control technology.

In accordance with some embodiments, when the document carrier device is in operation, it is configured to operate the heating device in order to generate heat both while the document carrier device is in the first mode of operation and also while it is in the second mode of operation. The heating device can thus be operated continuously without there being a need to provide, between different processing operations or for documents to be processed successively, a cooling phase followed by a heating phase for the heating device. This is made possible in particular by the protection mentioned above, due to its construction, from burns and makes a particularly energy-efficient operation and an increased document throughput possible, since the time periods which would otherwise be required for cooling down or heating up during a change of processing operations and/or during a changeover of documents can be saved.

In accordance with some embodiments, the document carrier device further comprises at least one adapter which is configured to be received on the support surface of the workpiece carrier and to be releasably fixed there in a releasable manner by a fixing device in order to define at least one receiving compartment for a document to be processed, which at least one receiving compartment is laterally limited to a specific shape and size below the size of the support surface. In this context, the position of the respective receiving compartment is defined by the adapter in such a way that at least one of the recesses in the workpiece carrier is located in the region of the receiving compartment. In this way, a document which is received in the receiving compartment can be heated by the heating device via the heat conducting element in the first mode of operation. The adapter may in particular be connected to the document carrier device in such a way that it can be moved manually or automatically onto the support surface as required, in particular in such a way that it can be folded or pivoted or pushed onto the support surface. As an alternative, it may also be a component which is detachable from the workpiece carrier and which is available as an accessory for the document carrier device in order to be introduced onto the support surface when required, in particular manually or automatically.

In particular, the outer contour of the adapter may be configured in such a way that it can cooperate with at least one wall surface or frame surface of the workpiece carrier delimiting the support surface, for example in the sense of a toothing or detent, in order to align the adapter on the support surface or to fix it with respect to one or more directions. With the aid of one or more different such adapters, the document carrier device can be configured in a simple and reliable manner specifically to receive a document, depending on the size of the document to be received, so that different types of documents, in particular different sizes of documents, can use the same document carrier device. For example, the support surface as a whole may be constructed to receive a passport, for example in the ID-3 format, while such an adapter may define a smaller receiving compartment specifically provided for cards, such as for example credit cards or bank cards, for example in the ID-1 format. In this way, a flexible use of the document carrier device with respect to the type of document and/or size of document is made possible.

In some of these embodiments, at least one of the adapters comprises a plate having at least one recess formed therein in order to define a respective receiving compartment. In particular, the recess may have a rectangular shape, or at least a substantially rectangular shape, (optionally with rounded corners) and may be adapted to the size of documents which are to be processed. In particular, the size and shape of the receiving compartment may correspond to a standardized document size, in particular to one of the document formats specified in particular in the ISO/IEC 7810 standard, such as for example the ID-1 format for cards or the ID-3 format for passports. Due to the fit achieved in this way, the document can be secured in particular against undesired translational or rotational movements on the support surface, and in particular the quality of a document processing operation of a document received in the receiving compartment can also be improved or ensured in this way.

In accordance with some embodiments, at least one of the adapters comprises a clamping mechanism for releasably fixing a document in the receiving compartment defined by the adapter or in a receiving compartment defined by the adapter. In this way, in particular in addition to the fit mentioned above, it is possible to achieve a safeguarding of the document against undesired movements in relation to the support surface and thus against quality losses during processing of the document.

In accordance with some embodiments, the document carrier device comprises at least a first and a second one of the adapters, which differ from each other in such a way that the first adapter defines a first receiving compartment for receiving a document which, at least substantially, laterally fills the first receiving compartment in a first orientation, and the second adapter defines a second receiving compartment for receiving a document which, at least substantially, laterally fills the second receiving compartment in a second orientation which is different from the first orientation, in each case relative to the workpiece carrier. In this context, the position of the respective receiving compartment is defined by the respective adapter in such a way that at least one of the recesses in the workpiece carrier is located in the region of the respective receiving compartment. In this way, a document which is received in the receiving compartment can be heated by the heating device via the heat conducting element in the first mode of operation. As used herein, "lateral" means in particular "in a plane which extends parallel to the support surface (or a planar portion thereof)". In this view, the thickness of the document, on the other hand, extends orthogonally to the lateral dimensions (length, width) of the receiving compartment and/or the document.

In accordance with some embodiments, at least one of the adapters may alternatively be fixed on the support surface in a first orientation or in a second orientation in a releasable manner, such that, in dependence upon the orientation of the adapter, the receiving compartment has a corresponding orientation that is different depending on the orientation of the adapter. In this way, a single adapter can be used to enable a document to be received in the two different orientations. In particular, this can be used in an advantageous manner if (i) the document is to be processed, under the action of heat, in two different locations on the document, or if (ii) the document is to be processed, under the action of heat, in the same location on the document but at different orientations of the document, or if (iii) by such a processing operation, features, in particular security features, are to be formed on the document which features, in particular security features, are dependent on the processing direction, such as CLI (changeable laser image) images or MLI (multiple laser image) images, for example.

In accordance with some embodiments, the workpiece carrier has a layer for shielding the support surface from magnetic fields. The layer may in particular comprise a ferrimagnetic oxide ceramic (ferrite) and may in particular be formed entirely therefrom. In this way, it is possible to achieve shielding of the spatial area which is intended for the receipt of the document from undesirable electromagnetic waves and, in particular, from electromagnetic waves which potentially interfere with data already stored electrically or magnetically on the document.

A second embodiment of the invention relates to a document processing system which comprises a document carrier device in accordance with the first embodiment of the invention. In this context, the document carrier device can be moved within the document processing system between: (i) a document loading position, at which the support surface of the document carrier is accessible for the purpose of receiving a document; (ii) at least one document processing position, at which a respective processing operation of a document which, at that time, is carried by the document carrier device on the support surface can be carried out by at least one document processing device which is associated with the respective document processing position; and (iii) a document unloading position, at which the support surface of the document carrier is accessible for the purpose of unloading a document therefrom. In some variants, the document unloading position may in particular coincide with the document loading position.

In the sense of the invention, a "processing device" is intended to be understood to mean in particular a subsystem of the document processing system which is set up to process a document, and in particular to apply information to it. For this purpose, the processing device may in particular comprise a printing device, for example an inkjet printer or a drop-on-demand printer (DoD printer), a marking laser or a programming head for writing information to a data memory present in the document, which information is present in the form of data. Also, the processing device may be multifunctional and may, for this purpose, comprise a plurality of different functionalities for processing a document, such as for example inkjet printing, laser treatment and data transfer. In the case of the application of printing, the information may be applied to the document using one or more inks, which may include, in particular, an ink intended for monochrome printing (for example for grayscale printing or black and white printing, and/or gradations thereof), one or more color inks, one or more UV fluorescent inks, and/or one or more IR sensitive inks. In addition, it is possible for the processing device to comprise a combination of at least one printing device for the application of at least one ink, as well as at least one additional post-treatment device for the respective ink, which additional post-treatment device is located downstream of the respective printing device, in particular a light source for drying the monochrome, multi-color and IR-sensitive inks and/or a source of ultraviolet (UV) light for curing UV-fluorescent inks.

The heating device itself, mentioned above, of the document carrier device can also be used, in particular for partially drying or completely drying applied ink. In addition, the processing device may additionally or alternatively be set up to apply a transparent ink or coating, in particular by a further printing device suitable for this purpose (for example "liquid coating"). Also, optionally, a plurality of processing devices may be provided in the device for processing documents, in particular in such a way that they process documents sequentially or in parallel. In some variants, different processing devices can also perform different processing steps for this purpose, such as for example, on the one hand, applying printing or performing a laser treatment and, on the other hand, writing electronic data into a memory of the document.

In accordance with some embodiments of the document processing system, the document processing system further comprises an inspection device, in particular a camera-based inspection device, which is configured to detect, in a sensor based manner, a position, a format, a type of document or a layout of a document received on the support surface of the workpiece carrier. In addition, the document processing system is then configured to control at least one of the document processing devices as a function of the detected position, the detected format, the detected type of document and/or the detected layout of the document in order to cause a correspondingly associated specific processing of the document.

The detection of a layout of the document in a sensor based manner mentioned above can be used in particular in such a way that, during any possible upstream processing operations or already during the course of the production of the document, an initial basic layout is already applied thereto, which in particular includes certain elements such as certain patterns (for example coat of arms), colors, lines, borders, fixed designations or letters (for example place of residence, signature, FRG, US), etc., and which is included in each document of a series of documents to be processed, and this is irrespective of any subsequent individual personalization (for example with respect to a specific holder of a document). In particular, this basic layout may be designed to be specific to the particular type of document (passport or card) and/or area of use (for example country) or type of use (for example driver's license, police ID card, etc.) and may be stored as a template in the document processing system. This basic layout can then subdivide the document into different layout areas in particular (see FIG. 3).

In particular, the document processing system can be configured to automatically detect, via the format and before the document processing (personalization), the size and/or dimensions of the document and, on the basis of this, its type of document as well. It is also possible to automatically detect the layout of the document to be processed and the layout areas in which the actual information (for example personalization) is then applied, for example by a laser or printer. The orientation of these layout areas as a result of the position of the document is also detected (for example document has an incorrect orientation, for example a slightly incorrect rotational orientation, with respect to the document carrier device or, if applicable, with respect to a receiving compartment of an adapter). The document processing system may then in particular also be configured to carry out, by a calibration, in particular by a software based calibration, a layout adjustment on the basis of the detected orientation. This can be done, for example, by a rotation in the opposite direction (correction) of the processing layout to compensate for a detected incorrect rotational orientation, in order for the document to be able to be processed without errors on the basis of this correction.

In particular, the document processing system can further be configured to carry out a quality inspection after the processing of a document, for example shortly before outputting it, to determine whether the information introduced onto or into the document during the course of the processing is correct per se (for example by a comparison with reference information) or whether it has been introduced onto or into the document in the correct manner, in particular whether it lies in the correct layout area, whether it is correctly arranged and aligned with respect to the layout, and whether any defects have occurred as a result of the processing. A corresponding signal or message can then be output, which is indicative of which defect was detected during the course of the quality inspection.

In accordance with some embodiments, the document processing system (200) further comprises a sensor device which is configured to detect, in a sensor based manner, a temperature of the workpiece carrier or of a document supported thereon, or another technical variable that is in a dependent relationship with this temperature. In addition, the document processing system is configured to control the heating device or another functional unit of the document processing system or a process sequence which can be executed by this, for processing the document as a function of the temperature or other technical variable detected by the sensor device. This can be used in particular for quality assurance or for monitoring for the document processing, for detecting any possible malfunctions of the document processing system or for detecting material defects or manufacturing defects which occur in a temperature dependent manner or which can be identified in a temperature dependent manner in or on the document.

In some of these embodiments, the document processing system is configured in particular to control a process sequence, which can be executed by the document processing system, for processing the document as a function of the temperature or other technical variable detected by the sensor device, in such a way that the process sequence is interrupted or terminated if, according to the detection, carried out by the sensor device, of the temperature or of the variable having a dependent relationship therewith, a predetermined target temperature of the document to be processed is not reached or exceeded within a predetermined period of time. In this way, effective action can be taken to address potential quality defects or other ones of the problems mentioned above and, in addition, unnecessary processing time for reject documents can be saved.

In accordance with some embodiments, at least one document processing device can be configured to selectively process, from different processing directions, a surface of a document, which surface is to be processed. In particular, the document processing device may be configurable, in particular it is possible that it can be oriented in a variable manner, to selectively generate CLI (changeable laser image) images or MLI (multiple laser image) images on or in a surface of a document to be processed. This makes a particularly efficient document processing possible in which the document can maintain its position, in particular its orientation, with respect to the document carrier device during its processing despite selective or cumulative processing from different processing directions. In some variants of the system, it may only be necessary, in order to process the front as well as the back of the document, just to turn the document over to its back accordingly, after the processing of the front, and vice versa.

The features and advantages explained in relation to the first embodiment of the invention apply, mutatis mutandis, to the second embodiment of the invention as well.

BRIEF DESCRIPTION OF THE DRAWINGS

Further advantages, features and possible applications of the present invention will be apparent from the following detailed description in connection with the drawings.

In the drawings.

In the figures, the same reference signs are used throughout for the same or for mutually corresponding elements of the invention.

DETAILED DESCRIPTION

Figure 1A:
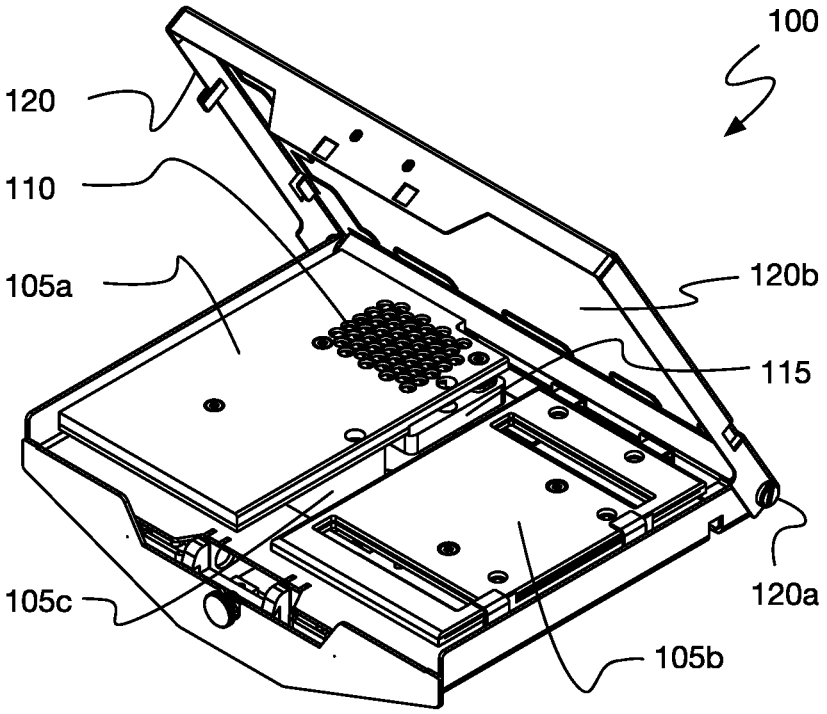
FIG. 1A schematically shows a perspective view of a document carrier device in accordance with an example embodiment of the present invention with the hinged cover open.
Figure 1B:
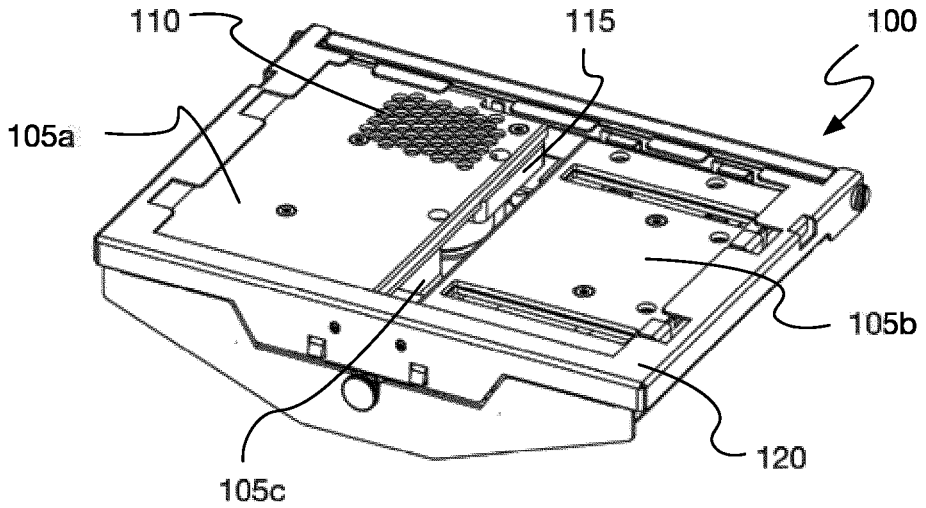
FIG. 1B schematically shows a perspective view of a document carrier device in accordance with an example embodiment of the present invention with the hinged cover closed.
Figure 4A:
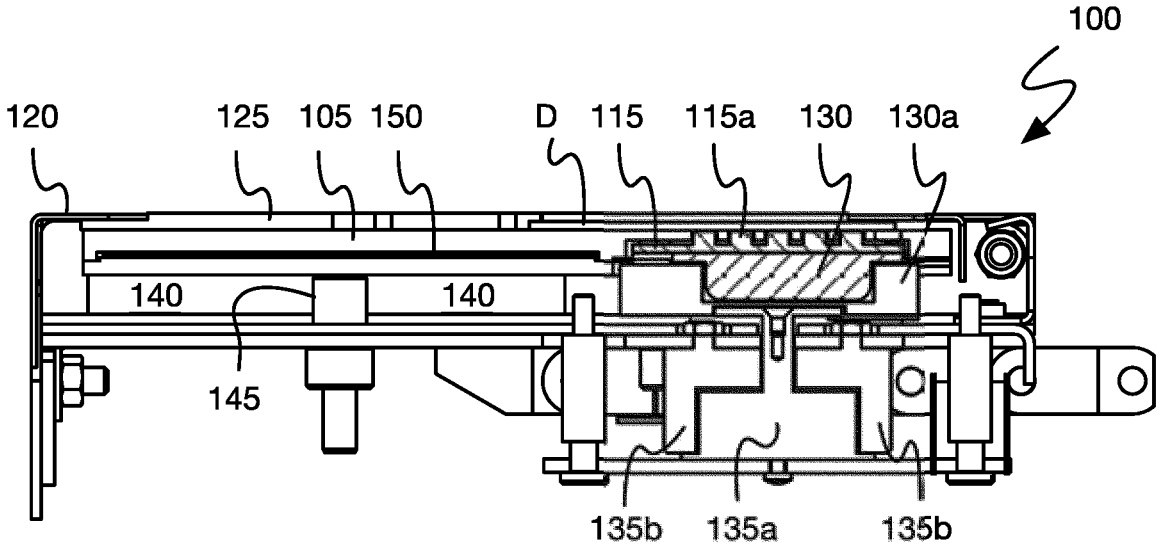
FIG. 4A schematically shows a lateral cross-sectional view in the cross-sectional plane A-A, shown in FIG. 2A of the document carrier device of FIG. 1A, in a first mode of operation for heating a document.
Figure 4B:
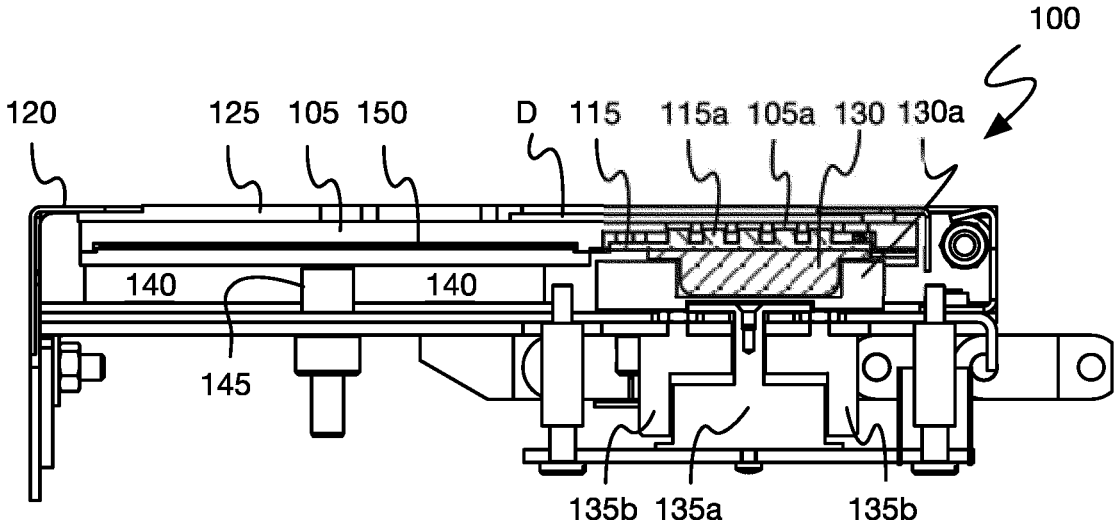
FIG. 4B schematically shows a lateral cross-sectional view in the cross-sectional plane A-A, shown in FIG. 2 in a second mode of operation with a heating device which has been placed in a safety position.

The example embodiment of a document carrier device 100 shown in FIGS. 1A and 1B comprises a workpiece carrier 105 with a support surface which is divided into a plurality of portions or partial surfaces 105*a* and 105*b* for receiving a document D to be processed (cf. FIGS. 4A and 4B). The two portions 105*a* and 105*b* are separated by an intermediate gap 105*c*. This serves in particular to enable booklet-like documents, such as for example passports, to be processed with ease, since here the spine of the booklet can be accommodated in the intermediate gap 105*c*, while opposite sides of the passport are supported by the two portions 105*a* and/or 105*b* of the support surface. However, embodiments are also possible in which the workpiece carrier 105 and/or its support surface are of a continuous construction, and in which the need for an intermediate gap 105*c* is thus eliminated.

In the region of the support surface, in the present example in the region of the partial surface 105*a*, a plurality of recesses 110 are provided in a grid-like arrangement, each of which may in particular have a circular cross-section. They serve as openings in the form of a passage for a heat conducting element 115 which is connected to a heating device 130 (cf. FIGS. 4A and 4B), which heat conducting element 115 is movably arranged below the workpiece carrier 105 and can be moved by an actuator in such a way that it can engage, at least in part, in the recesses 110 in order to be able to transfer heat generated by the heating device 130 to a document (not shown in FIGS. 1A and 1B) supported on the support surface 105*a*. Such heating of a document which is to be processed and which is supported on the support surface 105*a*, 105*b* may be provided in particular for the drying or fixing of ink which has previously been applied.

The document carrier device 100 further comprises a cover 120, which is formed here as a hinged cover which is pivotable about a hinge 120*a*. It is shown in FIG. 1A in the open state and in FIG. 1B in the closed state. The hinged cover 120 preferably comprises a large area opening 120*b* through which, in the closed state of the hinged cover, a processing of a document D, for example the application of printing onto a document D, supported on the support surface 105*a*, 105*b* is possible.

In particular, the document carrier device 100 can be used as a subsystem of a document processing system, such as for example the document processing system which is further explained below with reference to FIG. 5.

Figure 2A:
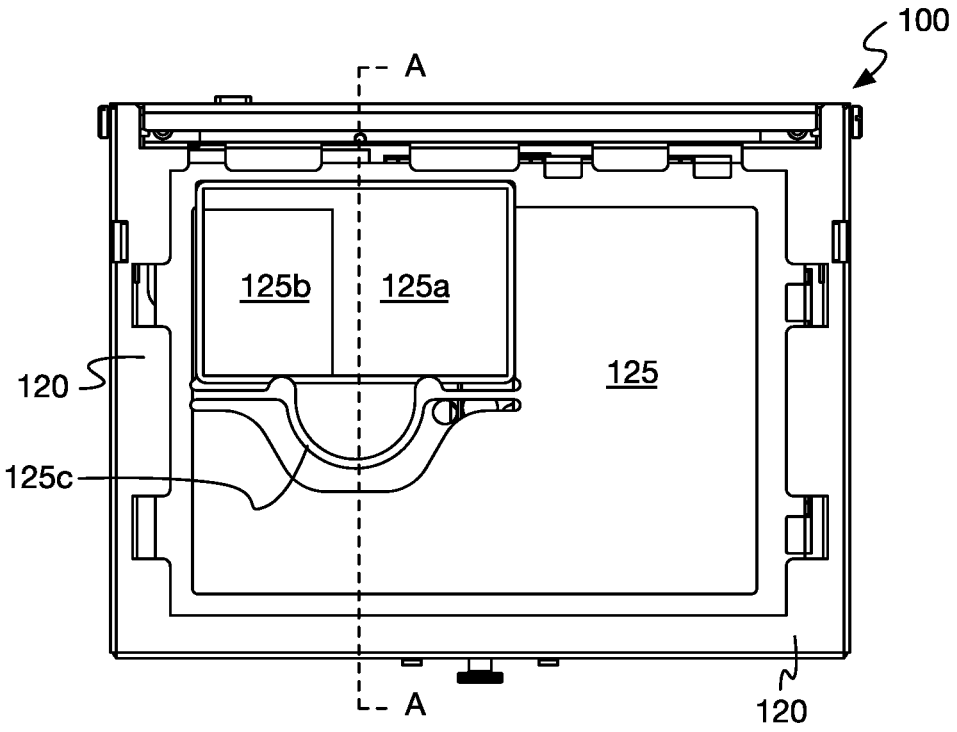
FIG. 2A schematically shows a top view of the document carrier device shown in FIG. 1 with the hinged cover closed and an adapter (a card adapter) located underneath.

FIG. 2A shows a top view of the document carrier device 100 from above with the hinged cover 120 closed, wherein an associated adapter 125, in particular a card adapter, with a receiving compartment 125*a*, defined by the card adapter 125, for a document D in the form of a card, such as for example a card-shaped identity card or a debit or credit card, is located on the support surface of the document carrier device 100. In particular, the receiving compartment 125*a* may correspond to the standardized ID-1 format mentioned above. In particular, the adapter 125 may be constructed substantially in the form of a plate and may be made of plastics material, for example. In particular, a region 125*b* may be defined in the receiving compartment 125*a*, which region 125*b* is intended for forming or processing an image on the card-shaped document D. This image region 125*b* may in particular overlap with the heating region of the document carrier device 100, and may in particular be congruent therewith, which heating region is defined by the recesses 110, so that the image region 125*b* can be heated by the heating device 130 and the heat conducting element 115 coupled thereto. In the present example, the adapter 125 further comprises a clamping device 125*c* by which a card D received in the receiving compartment can be mechanically fixed by clamping.

Figure 2B:
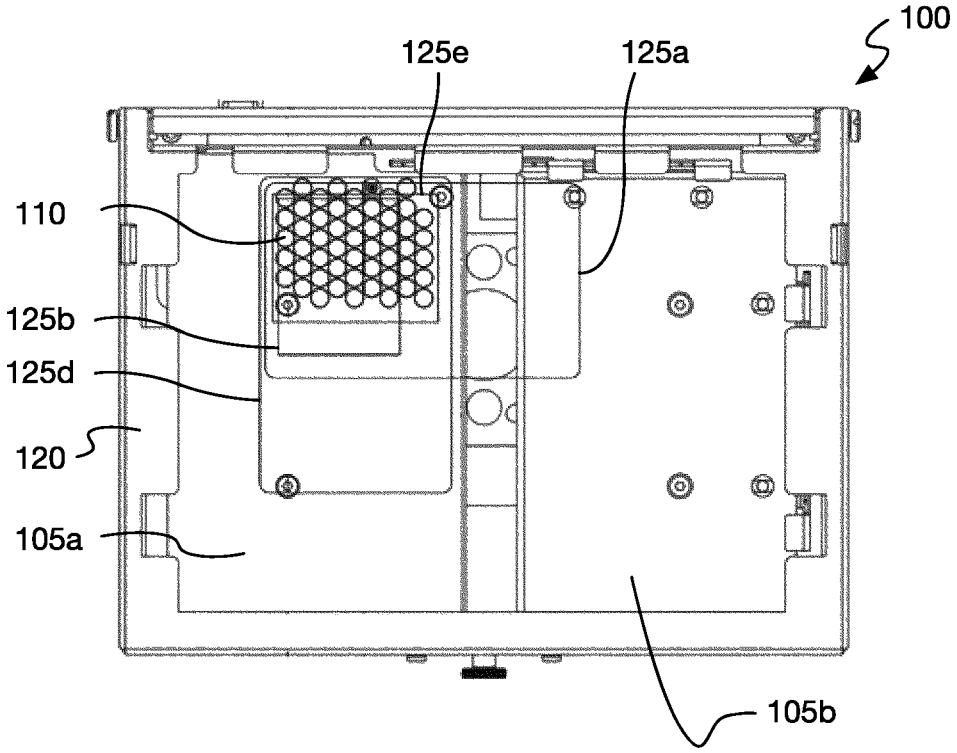
FIG. 2B schematically shows a top view of the document carrier device shown in FIG. 1 with the hinged cover closed and without the card adapter, but with two example positions of the receiving compartment of a card adapter indicated in the drawing.

FIG. 2B shows the same view of the document carrier device 100 again, but this time without the card adapter 125 inserted. However, for the purpose of illustrating different embodiments of the adapter, two particularly preferred possible positions 125*a* (corresponding to FIG. 2A) and 125*d* of the receiving compartment of the card adapter, together with their associated image regions 125*b* and 125*e*, are indicated in the drawing. Instead of these two positions, which are shown by way of example, other positions are also conceivable, whereby the receiving compartment 125*a* or 125*d*, in particular their respective image regions 125*b* or 125*e*, respectively, as far as defined, each need to overlap, at least in part, with the arrangement of the recesses 110 in order to make the desired supply of heat from the heating device 130 possible.

Figure 3:
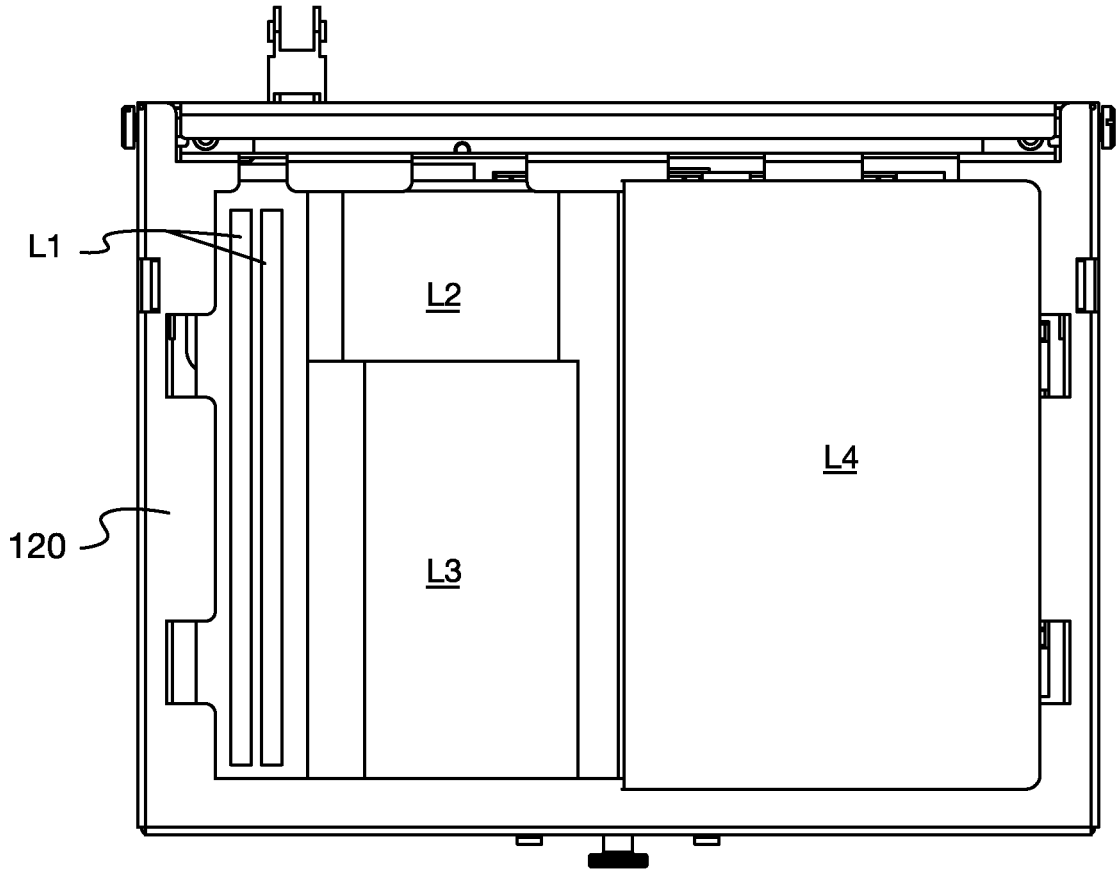
FIG. 3 schematically shows a top view of the document carrier device shown in FIG. 1 with the hinged cover closed and, underneath, a passport document accommodated in the document carrier device.

In FIG. 3, a further top view of the document carrier device 100 with the hinged cover 120 closed is shown from above, wherein an open booklet-like passport document D to be processed is accommodated on the workpiece carrier, which booklet-like passport document D may in particular have the standardized ID-3 format mentioned above. On the document, a number of different layout areas L1 to L4 are indicated, each of which is to undergo an associated processing operation within the framework of a processing operation of the document D.

In this context, the layout areas L1, L2 and L3 are located on a left page of the passport, in particular the page 2, as it is referred to, while the layout area L4 is located on a right page of the passport, in particular the page 3, as it is referred to. While the page 2 is typically formed of plastics material or of a laminate comprising plastic layers, the page 3 is often made of a paper material. The layout area L1 may in particular be intended to receive serial numbers, data relating to the passport holder, such as surname and first name for example, or other particularly important information. The layout area L2, which may in particular overlap with the heating region of the document carrier device or may even be congruent therewith, may in particular be intended to receive a passport photograph or an image of a passport holder, and the layout area L3 may form the core of the data page, as it is referred to (page 2), in which a number of data items, usually specific to the holder or issuer, is contained, which may in particular include the first name, surname, date of birth, place of issue and date of issue of the document D. In addition, the layout area L4 on page 3 is often intended in particular for receiving individual biometric data, such as the height or the eye color of the passport holder or also their passport photograph.

The layout areas for a card in the ID-3 format substantially correspond to those of the passport document D in the ID-1 format, but are smaller and/or adapted to the size of the card. In the case of the front of the card introduced into the receiving compartment of the adapter, the layout areas L2 and L3 may correspond to those of the booklet-type passport document D, in particular with respect to the information items which are to be applied to the document in the respective ones of these layout areas. Then, in the case of the back of the card inserted in the receiving compartment of the adapter, the layout areas L1 and L4 may also correspond to those of the booklet-type passport document D.

Preferably, the size of the receiving surface of the workpiece carrier 105 is determined in such a way that, on the one hand, it is already configured for the receipt of a common document format (for example ID-3) without the use of an adapter 125, while, on the other hand, document formats (for example ID-1) which are smaller when compared with this, can also be received with ease and fixed for processing through additional use of an adapter 125. When an adapter 125 is not used, the fixing of the document D to the workpiece carrier 105 is done by a clamping action exerted on the document D by the cover 120 in the closed state thereof. If an adapter 125 is used, the fixing of the document may instead be done, as has already been described above, in particular by a clamping mechanism 125*c* of the adapter 125 itself, in which case the adapter 125 is then advantageously fixed as a whole on the workpiece carrier 105 by a clamping action by the closed cover 120 and, if necessary, by mechanical alignment by one or more wall surfaces of the workpiece carrier 105 delimiting the support surface.

FIGS. 4A and 4B show the document carrier device 100 in the cross-sectional plane A-A of the document carrier device of FIGS. 1A and 1B, which cross-sectional plane A-A is shown in FIG. 2A and passes through the image region 125*b* of the receiving compartment 125*a*. In each of the views shown in FIGS. 4A and 4B, the hinged cover 120 is closed and a document D in the form of a card is received in the receiving compartment 125*a* of the card adapter 125 for processing on the support surface of the workpiece carrier 105. The workpiece carrier 105 is resiliently supported so that it can exert a clamping action on the card adapter 125 in cooperation with the closed hinged cover 120. Here, by way of example, the suspension is formed by an elastic foam mat 140.

A mechanical stop member in the form of a sleeve 145 is provided in order to limit the suspension travel path. Optionally, as shown, a layer 150 may be provided in or on the workpiece carrier 105 in order to shield the receiving area for the document D and, if applicable, the card adapter 125 from potentially interfering electromagnetic waves. Such interfering electromagnetic waves could in particular originate from the interior of a personalization system of which the document carrier device 100 may form a part, and could in particular act on any magnetic layers of the document D that may be present, in particular data storage layers, and thus damage or even erase data already stored on these. In particular, the layer 150 may comprise a ferrimagnetic oxide ceramic (ferrite) or may entirely be formed of this.

Below the image region 125*b* formed by the recesses 110 in the workpiece carrier 105, a heating device 130 is provided which has a heat conducting element 115 which is mounted thereon and which is formed as a plate having cylindrical protrusions 115*a*. The protrusions 115*a* correspond to the recesses 110 and are shaped and dimensioned in such a way that, in a first mode of operation of the document carrier device 100 illustrated in FIG. 4A, they extend through the recesses 110, or at least into the recesses 110, without touching them, in order to conduct heat generated by the heating device 130 towards the document D received in the receiving compartment 125*a* (operating position).

The heating device 130 is (optionally) supported in an associated heating device carrier 130*a* and can be moved by an actuator in a direction perpendicular to the support surface 105*a*, 105*b* in order to switch between the first mode of operation and a second mode of operation illustrated in FIG. 4B, in which the heating device and the heat conducting element are positioned further away from the support surface (safety position) than in the first mode of operation. Here, the actuator is constructed in the form of a solenoid with a movable part 135*a* (armature) and a fixed part (coil) 135*b* in correspondence thereto. In the second mode of operation or the safety position, the protrusions 115*a* of the heat conducting plate 115 heated by the heating device 130 are thus retracted into the recesses 110, or even out of the recesses 110, and are thus protected from unintentional contact by a user (protection from burns).

While the first mode of operation is thus used for processing the document and for simultaneously subjecting it to a heat treatment, the second mode of operation is in particular a safety mode which can be used in particular when loading the document carrier device 100 with a document D and/or unloading a document D from the document carrier device 100 (with the hinged cover 120 then at least temporarily open for this purpose). Due to the protection from burns made possible in this way, the heating device 130 can be heated continuously irrespective of whether the document carrier device 100 is currently in the first mode of operation or in the second mode of operation, so that, in particular, time-consuming and energy-consuming heating and cooling processes for each individual document D to be processed can be omitted, and thus the efficiency can be increased.

Figure 5:
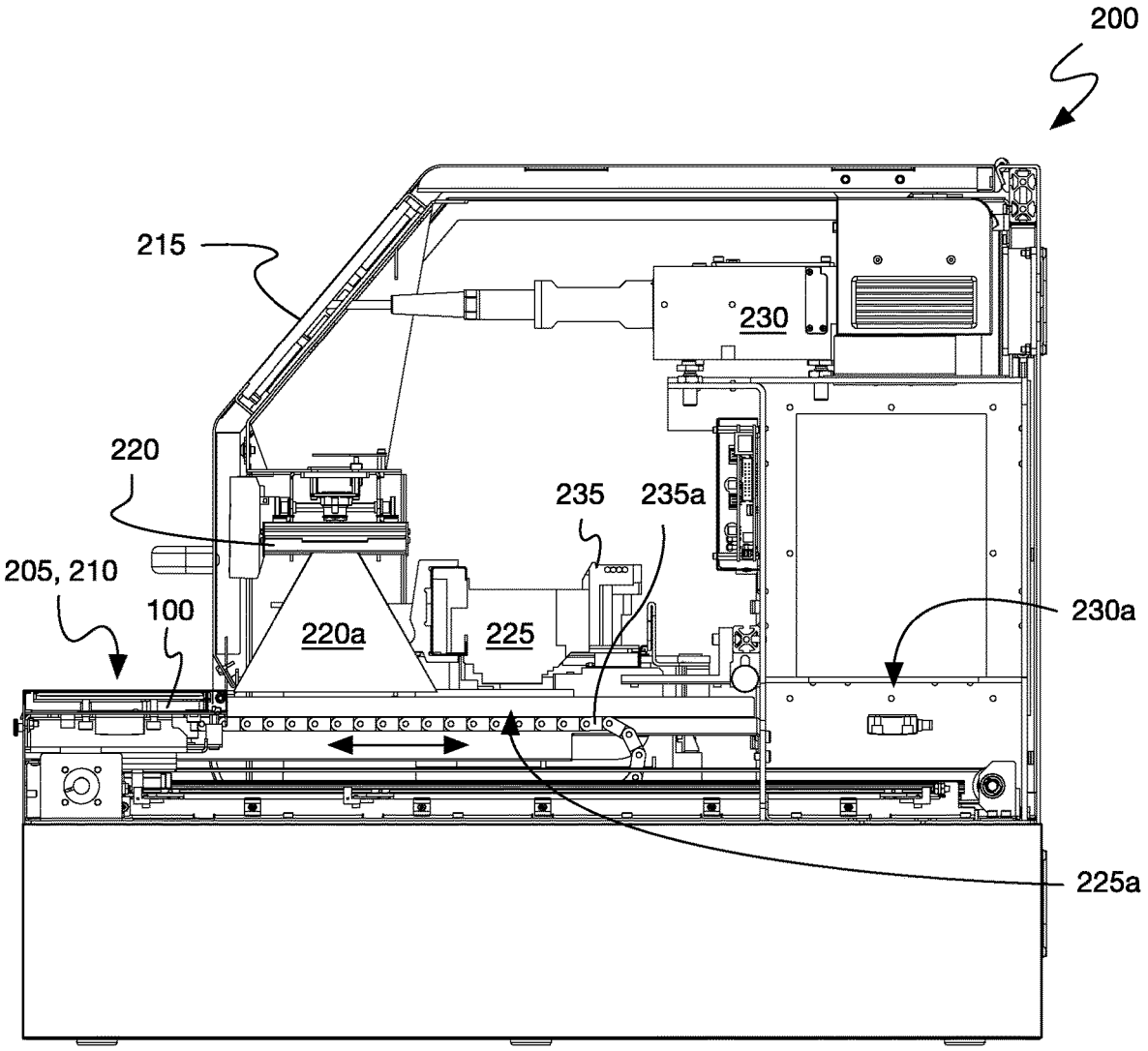
FIG. 5 schematically shows a lateral cross-sectional view of a document processing system with a document carrier device, in accordance with an example embodiment of the invention.

Finally, FIG. 5 illustrates an example embodiment of a document processing system 200, in which the document carrier device 100 mentioned above can be used as a subsystem. In the document processing system 200, the document carrier device 100 can be moved between different positions within the document processing system 200. For this purpose, the document carrier device 100 may be guided in particular by a miniature guide and may be movable by toothed belts and a motor (not shown in FIG. 5).

Said positions include, in particular, a loading position 205 as well as an unloading position 210 for loading the document carrier device 100 with a document D to be processed or already processed, or for unloading a document D to be processed or already processed from the document carrier device 100. In the example shown, these two positions 205 and 210 coincide. However, it is also conceivable to provide the loading position 205 at a different location from the unloading position 210, for example in such a way that the document carrier device 100 can be moved between these two positions 205 and 210 without change of direction and that, during the course of this, it can be processed at one or more processing positions of the document processing system 200 located along this path.

At one of the positions (inspection position), in particular an inspection of the document carrier device 100 loaded with a document D may be carried out. Expediently, for this purpose, the document processing system 200 may comprise an image sensor or a camera 220, in the field of view 220*a* of which the document carrier device 100, and thus the document accommodated thereby, is located when it stops at, or passes through, the inspection position. The visual inspection may serve in particular to determine an exact position of the document D in the document carrier device 100 and to carry out the further processing steps based thereon, in particular in the sense of an alignment of the associated document processing according to the exact position of the document which has been determined. In this way, variations in the exact position of the document that may possibly occur due to tolerances can be effectively compensated for, and thus a consistently high processing quality can be achieved. A determination of the type of document or a check with regard to whether the document is inserted incorrectly or is damaged can also be carried out within the framework of the inspection.

In particular, a printing device 225, for example an inkjet printing device, as well as a laser processing device comprising a laser 230 may be provided for processing the document. Such laser processing can be used in particular for applying information onto plastic materials or for introducing information into plastic materials, such as for example the "page 2" of a passport document or cards mentioned above. In particular, it is also possible to compose a combined image by combining the application of printing by the printing device 225 with a laser treatment. This can for example be done in the known CMYK color space in such a way that the color components C, M and Y are applied to the document D by inkjet printing and the further color component K ("key", black) by laser treatment. In the document processing system 200 illustrated in FIG. 5, the printing is envisaged at position 225*a* and the laser treatment is envisaged at position 230*a*, which is in the effective region of the laser 230.

In particular, it is possible to configure the direction from which the laser beam impinges on the surface of the document D to be processed, so that CLI or MLI processing is possible, in particular selectively. However, instead or cumulatively, it is also possible to achieve such different processing directions through the use of different card adapters with different orientations of the respective receiving compartments 125*a* or 125*d*, as is illustrated in FIG. 2B.

In order to introduce data into a memory device of the document D to be processed, a programming device may also be provided, which may in particular comprise a programming head 235, for example a magnetic or electric programming head 235, in order to store data in the document at a data transfer position 235*a*. In particular, the programming device may be constructed in the form of a read/write device for contactless or contact-based data transfer to or from a chip contained in the document, for example in the form of an RFID read/write device.

Ideally, the data transfer is carried out after processing of the document by printing and before processing of the document by laser. In this way, the ink has a little more time to dry after printing before the laser treatment is started.

In addition, the document processing system 200 may comprise a human-machine interface 215, in particular a touch screen, for its operation and for outputting information regarding current operating conditions or error messages or other information regarding the document processing system 200 or an ongoing document processing operation, which information may be relevant to a user of the document processing system 200. In particular, this may be configured in such a way that a selection of specific document processing operations (job selection) or of processing jobs can be carried out via the human-machine interface 215, or that an image of the document D captured by a camera can be displayed at at least one point in time during the processing of the document D by the document processing system 200. In addition, the human-machine interface 215 may be configurable so that, through this, a target layout for the document and its target position can be compared or viewed, in particular in real time, in relation to an actual layout and an actual position of the document as detected in a sensor based manner.

While at least one example embodiment has been described above, it is to be noted that a large number of variations thereto exist. In this context it is also to be noted that the example embodiments described herein only illustrate non-limiting examples, and that it is not intended thereby to limit the scope, the applicability, or the configuration of the devices and methods described herein. Rather, the preceding description will provide the person skilled in the art with instructions for the implementation of at least one example embodiment, whereby it is to be understood that various changes in the functionality and the arrangement of the elements described in an example embodiment can be made without thereby deviating from the subject matter respectively set forth in the appended claims as well as legal equivalents to this.

What is claimed is:

1. A document carrier device for supporting and transporting a document in a document processing system, comprising:

a workpiece carrier comprising a support surface for receiving a document;

a heating device comprising a heat conducting element for transferring heat generated by the heating device; and an actuator for causing relative movement between the heat conducting element and the workpiece carrier in order to change between a first mode of operation and a second mode of operation of the document carrier device, wherein, in the first mode of operation, the heat conducting element extends, without thereby being in mechanical contact with the workpiece carrier, through one or more recesses in the workpiece carrier in a region of the support surface to be able to transfer heat generated by the heating device, at least in part, to a document received on the support surface of the workpiece carrier; and wherein, in the second mode of operation, the heat conducting element has a distance from the support surface which is increased when compared with its position in the first mode of operation.

2. The document carrier device of claim 1, wherein the heat conducting element comprises a plate-shaped body having a number N≥1 of protrusions which extend away therefrom from one side of the body;

wherein, in the first mode of operation, each of the protrusions extend through an associated one of the recesses in the workpiece carrier without thereby being in mechanical contact with the workpiece carrier to be able to transfer heat generated by the heating device, at least in part, to a document received on the support surface of the workpiece carrier, and wherein, in the second mode of operation, the protrusions are at least partially retracted from their respective recesses so as to be at a greater distance from the support surface when compared with their respective position in the first mode of operation.

3. The document carrier device of claim 2, wherein at least one of the protrusions has a cylindrical shape.

4. The document carrier device of claim 1, wherein the workpiece carrier is resiliently supported by a suspension in such a way that, when the support surface is subjected to a contact pressure force which is directed at least partially orthogonally to the support surface, the workpiece carrier can move along a suspension travel path while at the same time giving rise to a counterforce caused by the suspension, which counterforce counteracts this movement.

5. The document carrier device of claim 4, wherein the suspension travel path is limited in such a way that the workpiece carrier, when it is moved along the entire suspension travel path, does not come into mechanical contact with the heating device or with the heat conducting element directly or indirectly via at least one other component at any point of this movement.

6. The document carrier device of claim 5, wherein a limitation of the suspension travel path is formed by a mechanical stop member for the movement of the workpiece carrier along the suspension travel path.

7. The document carrier device of claim 4, wherein the suspension comprises at least one spring element which comprises, or consists of, elastic foam material.

8. The document carrier device of claim 1, further comprising:

a cover which is arranged so as to be movable between an open position and a closed position, wherein, in the open position, it exposes the support surface for loading and unloading a document and, in the closed position, it covers the support surface in such a way that, between the support surface and the cover, a receiving space which is closed on at least two sides is defined for a document to be processed.

9. The document carrier device of claim 1, wherein the actuator is configured to effect the relative movement between the heat conducting element and the workpiece carrier on a basis of a principle of magnetic action.

10. The document carrier device of claim 1, further comprising:

a sensor device which is configured to detect, in a sensor based manner, a temperature of the workpiece carrier or of a document supported thereon, or another technical variable that is in a dependent relationship with said temperature;

wherein the document carrier device is configured to control the heating device as a function of the temperature or other technical variable detected by the sensor device.

11. The document carrier device of claim 1, wherein, when the document carrier device is in operation, it is configured to operate the heating device to generate heat both while the document carrier device is in the first mode of operation and also while it is in the second mode of operation.

12. The document carrier device of claim 1, further comprising:

at least one adapter which is configured to be received on the support surface of the workpiece carrier and to be releasably fixed there in a releasable manner by a fixing device to define at least one receiving compartment for a document to be processed, which at least one receiving compartment is laterally limited to a specific shape and size below the size of the support surface, wherein the position of the respective receiving compartment is defined by the at least one adapter in such a way that at least one of the recesses in the workpiece carrier is located in a region of the receiving compartment.

13. The document carrier device of claim 12, wherein at least one of the adapters comprises a plate having at least one recess formed therein to define a respective receiving compartment.

14. The document carrier device of claim 12, wherein at least one of the adapters comprises a clamping mechanism for releasably fixing a document in the receiving compartment defined by the adapter or in a receiving compartment defined by the adapter.

15. The document carrier device of claim 12, comprising at least a first and a second one of the adapters, which differ from each other in such a way that the first adapter defines a first receiving compartment for receiving a document which, at least substantially, laterally fills the first receiving compartment in a first orientation, and the second adapter defines a second receiving compartment for receiving a document, which, at least substantially, laterally fills the second receiving compartment in a second orientation which is different from the first orientation, in each case relative to the workpiece carrier, wherein the position of the respective receiving compartment is defined by the respective adapter in such a way that at least one of the recesses in the workpiece carrier is located in a region of the respective receiving compartment.

16. The document carrier device of claim 12, wherein at least one of the adapters can alternatively be fixed on the support surface in a first orientation or in a second orientation in a releasable manner, such that, in dependence upon the orientation of the adapter, the receiving compartment has a corresponding orientation that is different depending on the orientation of the adapter.

17. The document carrier device of claim 1, wherein the workpiece carrier has a layer for shielding the support surface from magnetic fields.

18. A document processing system comprising:

the document carrier device of claim 1, wherein the document carrier device can be moved within the document processing system between:

a document loading position, at which the support surface of the workpiece carrier is accessible for the purpose of receiving a document;

at least one document processing position, at which a respective processing operation of a document which, at that time, is carried by the document carrier device on the support surface can be carried out by at least one document processing device which is associated with the respective document processing position; and a document unloading position, at which the support surface of the workpiece carrier is accessible for the purpose of unloading a document therefrom.

19. The document processing system of claim 18, further comprising:

an inspection device which is configured to detect, in a sensor based manner, a position, a format or a type of document, as well as a layout of a document received on the support surface of the workpiece carrier;

wherein the document processing system is configured to control at least one of the document processing devices as a function of the detected position, the detected format or the detected type of document, as well as the detected layout of the document to cause a correspondingly associated specific processing of the document.

20. The document processing system of claim 18, further comprising:

a sensor device which is configured to detect, in a sensor based manner, a temperature of the workpiece carrier or of a document supported thereon, or another technical variable that is in a dependent relationship with said temperature;

wherein the document processing system is configured to control the heating device or another functional unit of the document processing system or a process sequence which can be executed by this, for processing the document as a function of the temperature or other technical variable detected by the sensor device.

21. The document processing system of claim 20, wherein the document processing system is configured to control a process sequence, which can be executed by the document processing system, for processing the document as a function of the temperature or other technical variable detected by the sensor device, in such a way that the process sequence is interrupted or terminated if, according to the detection, carried out by the sensor device, of the temperature or of the variable having a dependent relationship therewith, a predetermined target temperature of the document to be processed is not reached or exceeded within a predetermined period of time.

* * * * *